US011225742B2

(12) United States Patent
Poy

(10) Patent No.: US 11,225,742 B2
(45) Date of Patent: Jan. 18, 2022

(54) COMBINATION FLOW TUNNEL

(71) Applicant: PELLERIN MILNOR CORPORATION, Kenner, LA (US)

(72) Inventor: Russell H. Poy, New Orleans, LA (US)

(73) Assignee: PELLERIN MILNOR CORPORATION, Kenner, LA (US)

( * ) Notice: Subject to any disclaimer, the term of this patent is extended or adjusted under 35 U.S.C. 154(b) by 574 days.

(21) Appl. No.: 15/601,975

(22) Filed: May 22, 2017

(65) Prior Publication Data

US 2017/0335499 A1 Nov. 23, 2017

Related U.S. Application Data

(60) Provisional application No. 62/339,457, filed on May 20, 2016.

(51) Int. Cl.
*D06F 31/00* (2006.01)
*C11D 11/00* (2006.01)

(52) U.S. Cl.
CPC ..... *D06F 31/005* (2013.01); *C11D 11/0017* (2013.01); *C11D 11/0064* (2013.01)

(58) Field of Classification Search
CPC .... D06F 31/005; D06F 31/00; D06F 2232/00; D06F 35/006; D06F 35/005
(Continued)

(56) References Cited

U.S. PATENT DOCUMENTS 3,330,139 A * 7/1967 Schafer ..... D06F 31/005 68/58
3,481,347 A * 12/1969 Corbett ..... B65G 49/0422 134/69

(Continued)

FOREIGN PATENT DOCUMENTS

CN 102939414 2/2013
EP 1205590 5/2002

OTHER PUBLICATIONS

PCT International Search Report and Written Opinion of the International Searching Authority; PCT/US2017/033877 Filed May 22, 2017.

(Continued)

*Primary Examiner* — David G Cormier
*Assistant Examiner* — Thomas Bucci
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

A method of washing fabric articles in a continuous batch tunnel washer, comprises providing a continuous batch tunnel washer having an interior, an intake, a discharge, and a plurality of modules that segment the interior. Fabric articles are moved from the intake to the discharge and through the modules in sequence. One or more modules define a wash zone for washing the fabric articles. One or more of the modules are rinse modules that have a perforated scoop. Some of the modules do not have a perforated scoop. After washing fabric articles, the fabric articles can be rinsed by counter flowing liquid in the washer interior at spaced apart modules and along a flow path that is generally opposite the direction of travel of the fabric articles from the intake to the discharge. Velocity rinsing can also replace a continuous counter flow. To improve rinsing and washing, one or more modules may be dilution zone modules, which receives a flow stream from the rinsing modules via a booster pump. A dilution zone module or drum preferably has a perforated scoop to drain the free water when transferring to the next dilution zone module or drum. Drums or modules without shells (carryover modules) have scoops for fabric article (e.g., linen) transfer with no perforations. Thus, the linen and all water go to the next downstream drum at the carryover modules.

28 Claims, 10 Drawing Sheets

| Functions | |
|---|---|
| Module | Operation |
| ① | Pre-wash + Wash |
| ② | Carry over |
| ③ | Dilution (drain) + Alkali |
| ④ | Dilution + Bleach |
| ⑤ | Carry over |
| ⑥ | Rinse |
| ⑦ | pH adjustment + Softener |

PulseFlow (last 25% of cycle)
The PulseFlow tank provides 400 liters per minute for counterflow. Counterflow is from module 6 to 4 to 3 to 1. After module 1, flow is to sewer.

(58) Field of Classification Search
USPC ..... 8/158, 159, 137, 147; 68/27, 58, 143, 68/140, 145, 142, 210, 24, 207; 134/66, 134/69, 159, 65
See application file for complete search history.

(56) References Cited

U.S. PATENT DOCUMENTS 3,707,858 A * 1/1973 Gulzow ..... D06F 31/005 68/143
3,878,699 A * 4/1975 Steinort ..... D06F 31/005 68/145
3,969,913 A * 7/1976 Schaper ..... D06F 31/005 68/143
3,995,458 A * 12/1976 Grunewald ..... D06F 31/005 68/140
4,020,659 A * 5/1977 Bhavsar ..... D06F 37/30 68/27
4,034,583 A * 7/1977 Miessler ..... D06F 31/005 68/16
4,156,358 A * 5/1979 Harrsch ..... D06F 37/06 68/142
4,236,393 A * 12/1980 Katzfey ..... D06F 31/005 68/27
4,363,090 A 12/1982 Garcia
4,391,108 A * 7/1983 Albers ..... D06F 31/005 198/658
4,478,060 A * 10/1984 Grunewald ..... D06F 31/005 68/27
4,485,509 A * 12/1984 Pellerin ..... D06F 31/005 68/27
4,519,224 A * 5/1985 Seifert ..... D06F 31/005 68/143
4,522,046 A * 6/1985 Dreher ..... D06F 31/005 68/140
4,546,511 A * 10/1985 Kaufmann ..... D06F 39/006 8/158
4,607,509 A * 8/1986 Stoll ..... D06F 31/005 68/27
4,616,372 A * 10/1986 Stoll ..... D06F 31/005 8/158
4,694,665 A * 9/1987 Stoll ..... D06F 31/005 68/27
4,829,792 A * 5/1989 Keith ..... D06F 31/005 68/158
4,841,751 A * 6/1989 Ricci ..... D06B 11/0096 451/328
4,848,107 A * 7/1989 Stoll ..... D06F 31/005 68/27
4,856,302 A * 8/1989 Eck ..... D06F 31/005 68/27
4,984,438 A * 1/1991 Batty ..... D06B 11/0096 68/143
5,211,039 A * 5/1993 Pellerin ..... D06F 31/005 68/140
5,307,652 A * 5/1994 Hagiwara ..... D06F 31/005 68/27
5,333,475 A * 8/1994 Edmundson ..... D06F 31/005 68/139
5,392,480 A * 2/1995 Ishihara ..... D06F 31/005 8/159
5,426,958 A * 6/1995 Sheppard ..... D06F 31/005 68/142
5,454,237 A * 10/1995 Pellerin ..... D06F 31/005 68/143
5,487,283 A * 1/1996 Sheppard ..... D06F 31/005 68/142
5,564,292 A * 10/1996 Geiger ..... D06F 31/005 68/140
5,564,595 A 10/1996 Minissian
6,076,379 A * 6/2000 Grandpierre ..... D06F 31/005 68/27
6,238,516 B1 * 5/2001 Watson ..... D21B 1/026 162/8
6,684,441 B2 * 2/2004 Mehrmann ..... D06F 31/005 8/158
6,796,150 B2 * 9/2004 Bringewatt ..... D06F 31/005 68/142
7,197,901 B2 4/2007 Monteiro et al.
7,971,302 B2 7/2011 Poy et al.
8,336,144 B2 * 12/2012 Poy ..... D06F 31/005 8/158
8,370,981 B2 * 2/2013 Poy ..... D06F 31/005 8/158
8,635,890 B2 1/2014 Jeong et al.
9,127,389 B2 9/2015 Poy et al.
9,200,398 B2 12/2015 Poy
9,580,854 B2 2/2017 Poy et al.
2001/0054203 A1 * 12/2001 Bringewatt ..... D06F 31/005 8/159
2002/0038481 A1 * 4/2002 Stoll ..... D06F 31/005 8/158
2002/0083742 A1 * 7/2002 Bringewatt ..... D06F 31/005 68/27
2002/0104172 A1 * 8/2002 Mehrmann ..... D06F 31/005 8/158
2003/0110576 A1 * 6/2003 ten Have ..... D06F 31/005 8/158
2003/0110815 A1 * 6/2003 Poy ..... D06F 31/005 68/27
2009/0106914 A1 * 4/2009 Bringewatt ..... D06F 31/00 8/159
2009/0165217 A1 * 7/2009 Pillsticker ..... D06F 31/00 8/159
2009/0260161 A1 * 10/2009 Poy ..... D06F 31/005 8/115.6
2009/0260162 A1 * 10/2009 Poy ..... D06F 31/005 8/115.6
2010/0146711 A1 * 6/2010 Bringewatt ..... D06F 31/00 8/137
2010/0269267 A1 * 10/2010 Poy ..... D06F 35/005 8/159
2011/0011136 A1 * 1/2011 Wientjens ..... D06F 39/04 68/15
2011/0173761 A1 * 7/2011 Bringewatt ..... D06F 29/02 8/137
2011/0225741 A1 9/2011 Poy et al.
2011/0296626 A1 * 12/2011 Poy ..... D06L 1/16 8/137
2013/0291314 A1 * 11/2013 Poy ..... D06F 31/005 8/137
2014/0053343 A1 * 2/2014 Poy ..... D06F 31/005 8/137
2016/0097147 A1 * 4/2016 Poy ..... D06F 31/005 8/137

OTHER PUBLICATIONS

Supplementary European Search Report dated Dec. 9, 2019—European Application No. 17800342.2 corresponding to PCT/US2017/033877.

* cited by examiner

PulseFlow (last 25% of cycle)
The PulseFlow tank provides 400 liters per minute for counterflow. Counterflow is from module 6 to 4 to 3 to 1. After module 1, flow is to sewer.

| Functions | |
|---|---|
| Module | Operation |
| 1 | Pre-wash + Wash |
| 2 | Carry over |
| 3 | Dilution (drain) + Alkali |
| 4 | Dilution + Bleach |
| 5 | Carry over |
| 6 | Rinse |
| 7 | pH adjustment + Softener |

PulseFlow (last 25% of cycle)
The PulseFlow tank provides 400 liters per minute for counterflow. Counterflow is from module 15 to 14 to 13 to 8 to 7 to 6 to 1. After module 1, flow is to sewer.

| Functions | |
|---|---|
| Module | Operation |
| 1 | Pre-wash |
| 2 | Wash |
| 3 - 5 | Carryover |
| 6 | Dilution (drain) + Alkali |
| 7 | Rinse |
| 8 | Dilution + Bleach |
| 9 - 12 | Carryover |
| 13 - 15 | Rinse |
| 16 | pH adjustment + Softener |

COMBINATION FLOW TUNNEL

CROSS-REFERENCE TO RELATED APPLICATIONS

This application claims benefit of U.S. Provisional Patent Application Ser. No. 62/339,457, filed 20 May 2016, which is hereby incorporated herein by reference.

Priority of U.S. Provisional Patent Application Ser. No. 62/339,457, filed 20 May 2016, which is incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to washing machines. More particularly, the present invention relates to an improved washing machine and method, the washing machine having multiple modules and wherein some modules have perforated scoops, some modules have outer shells and wherein some modules do not have scoops and/or shells.

2. General Background

Patents have issued for large commercial type washing machines typically referred to "tunnel washers" or "tunnel batch washers" or "continuous batch tunnel washers". Examples can be seen in U.S. Pat. Nos. 4,236,393; 9,127,389 (US Patent Application Publication No. 2010/0269267); and U.S. Pat. No. 9,580,854 (US Patent Application Publication No. 2013/0291314), each of which is hereby incorporated herein by reference. Such tunnel washers have multiple modules. In U.S. Pat. No. 4,236,393, each module is a cylindrical casing having a peripheral wall with perforated areas. The '393 patent provides a continuous tunnel batch washer of modular construction with the number of modules varying depending upon installational requirements. Each module includes a drum rotatably supported and driven to oscillate in a predetermined manner during the washing cycle and to rotate unidirectionally during transfer of the load from one module to a succeeding module with a chute or trough arrangement extending between the modules for transferring the wash load from one module to a next successive module. The drum in each module is roller supported and chain driven from a common shaft with a plurality of independent motors driving the shaft by a belt drive with each module including a reduction gear driven from the shaft and having an output driving the sprocket chain for the oscillatable and rotatable drum. A programmed control device provides continuous control of each batch of articles being laundered as they progress to the successive module in the machine. In the '393 patent, all scoops are perforated. Perforated transfer scoops are also discussed in the above listed U.S. Pat. Nos. 9,127,389 and 9,580,854.

Some prior art washing machines are based on counter flow high velocity rinsing after standing bath washing (e.g., see U.S. Pat. No. 8,336,144 (US Patent Application Publication No. 2011/0225741), incorporated herein by reference). The counter flow starts in the last module, or typically the module before the last module, and flows at high velocity sequentially through each upstream module and finally exiting upstream (e.g., at the first module). This requires that all modules have an outer shell for the water to flow in and out. Additionally, there must be a barrier in the lower part of the shell to separate the water between drums. Each module can be a dual use module.

Another prior art tunnel washer type machine is a bottom transfer machine where the drum holding the fabric articles (linen) is also the drum holding the water. There is no outer shell. When the standing bath is finished, the linen (or fabric articles to be cleaned) and all the water is transferred to the next attached module or drum. In the middle of the machine, there are two or more drums that are fitted with an outer shell. The outer shell has a drain valve and water refill valve (i.e. a dilution zone). To achieve the dilution function, the drum is drained and refilled at least once. All of the fabric articles (e.g., linen) and water are transferred to the next contiguous module or drum which also has an outer shell. The water and fabric articles (e.g., linen) can be heated to between about 40 degrees and 80 degrees Celsius. Rinsing is done with counterflow in two or more downstream modules at low velocity typically about 20 to 50 gallons per minute or "GPM" (about 75.70 to 189.27 liters per minute) on a continuous basis. All modules can be single function modules.

The following table lists possibly relevant patents (each hereby incorporated herein by reference) directed to other washing machines including some tunnel washing machines.

| U.S. PAT. NO. | TITLE | ISSUE DATE MM/DD/YYYY |
|---|---|---|
| 9,580,854 | CONTINUOUS BATCH TUNNEL WASHER AND METHOD | 02/28/2017 |
| 9,200,398 | CONTINUOUS BATCH TUNNEL WASHER AND METHOD | 12/01/2015 |
| 9,127,389 | CONTINUOUS BATCH TUNNEL WASHER AND METHOD | 09/08/2015 |
| 8,635,890 | PEDESTAL WASHING MACHINE | 01/28/2014 |
| 8,370,981 | INTEGRATED CONTINUOUS BATCH TUNNEL WASHER | 02/12/2013 |
| 8,336,144 | CONTINUOUS BATCH TUNNEL WASHER AND METHOD | 12/25/2012 |
| 7,971,302 | INTEGRATED CONTINUOUS BATCH TUNNEL WASHER | 07/05/2011 |

-continued

| U.S. PAT. NO. | TITLE | ISSUE DATE MM/DD/YYYY |
|---|---|---|
| 7,197,901 | WASHING MACHINE | 04/03/2007 |
| 6,796,150 | INSTALLATION FOR THE WET-TREATMENT OF LAUNDRY, AND SEAL FOR SUCH AN INSTALLATION | 09/28/2004 |
| 6,238,516 | SYSTEM AND METHOD FOR CLEANING, PROCESSING, AND RECYCLING MATERIALS | 05/29/2001 |
| 5,564,595 | CHEMICAL DISPENSING SYSTEM | 10/15/1996 |
| 5,564,292 | WASHING MACHINE | 10/15/1996 |
| 5,454,237 | CONTINUOUS BATCH TYPE WASHING MACHINE | 10/03/1995 |
| 5,392,480 | WASHING METHOD BY A CONTINUOUS WASHING MACHINE | 02/28/1995 |
| 5,211,039 | CONTINUOUS BATCH TYPE WASHING MACHINE | 05/18/1993 |
| 4,984,438 | PROCESSING OF DENIM GARMENTS | 01/15/1991 |
| 4,829,792 | DOUBLE DRUM BATCH WASHING MACHINE | 05/16/1989 |
| 4,522,046 | CONTINUOUS BATCH LAUNDRY SYSTEM | 06/11/1985 |
| 4,485,509 | CONTINUOUS BATCH TYPE WASHING MACHINE AND METHOD FOR OPERATING SAME | 12/04/1984 |
| 4,363,090 | PROCESS CONTROL METHOD AND APPARATUS | 12/07/1982 |
| 4,236,393 | CONTINUOUS TUNNEL BATCH WASHER | 12/02/1980 |

BRIEF SUMMARY OF THE INVENTION

The apparatus and method of the present invention improves the washing and rinsing functions of a bottom transfer type machine. The present invention includes a method of washing fabric articles in a continuous batch tunnel washer, comprising providing a continuous batch tunnel washer preferably having an interior, an intake, a discharge, and a plurality of modules or drums that segment the interior. Fabric articles are moved from the intake to the discharge and through the modules in sequence. One or more modules define a wash zone for washing the fabric articles. One or more of the modules are rinse modules that have a perforated scoop, and some of the modules do not have a perforated scoop. A washing chemical may be added to one or more of the modules. After washing fabric articles, the fabric articles can be rinsed by counter flowing liquid in the washer interior at multiple locations along a flow path that is generally opposite the direction of travel of the fabric articles from the intake to the discharge.

With the present invention, high velocity rinsing can replace a continuous counterflow. Because of the efficiency of the high velocity (e.g., 80 to 180 GPM (302.83 to 681.37 liters per minute)), fewer drums or modules are required for the same level of dilution. In some embodiments, there are a plurality of rinsing modules or rinsing drums. The rinsing modules or drums preferably have perforated scoops and outer shells to improve rinsing efficiency. In one embodiment of the apparatus of the present invention, only one rinsing module or drum is required.

To improve rinsing and washing, one or more modules may be dilution zone modules, which receive a flow stream from rinsing modules preferably via a booster pump. This dilution zone module or drum preferably has a perforated scoop to drain the free water when transferring to the next dilution zone module or drum. Drums or modules without shells (as shown in the drawings) preferably have scoops for fabric article (e.g., linen) transfer with no perforations. These are carryover modules. Thus, the linen and all water preferably go to the next downstream module or drum.

The improvements of the present invention include a much lower manufacturing cost, fewer modules or drums, and improved washing and rinsing functions.

The present invention includes a method of washing fabric articles in a continuous batch tunnel washer, comprising providing a continuous batch tunnel washer preferably having an interior, an intake, a discharge, a plurality of modules, and a volume of liquid. The fabric articles can be moved from the intake to the modules and then to the discharge in sequence. One or more of the modules can have a perforated scoop. In one embodiment, the present invention includes not counter flowing a rinsing liquid in the washer interior for a selected time interval. In one embodiment, counter flowing a rinsing liquid can occur along a flow path that is generally opposite the direction of travel of the fabric articles. In one embodiment, boosting the pressure of the counter flowing rinsing liquid occurs with a booster pump at one or more positions spaced preferably in between the intake and the discharge.

In one embodiment, multiple booster pumps can be provided, each pump boosting counter flowing rinsing liquid flow rate preferably at a different one of said modules.

In one embodiment, there can be multiple said modules preferably with perforated scoops.

In one embodiment, the booster pumps can be spaced apart preferably by more than one module.

In one embodiment, the booster pump preferably discharges liquid into a module that has an outer shell.

In one embodiment, the booster pumps preferably each discharge liquid into a module that does not have a perforated scoop.

In one embodiment, flow can be substantially halted for a time period that is preferably less than about five minutes.

In one embodiment, flow can be substantially halted for a time period that is preferably less than about three minutes.

In one embodiment, flow can be substantially halted for a time period that is preferably less than about two minutes.

In one embodiment, flow can be substantially halted for a time period that is preferably between about twenty and one hundred twenty (20-120) seconds.

The present invention includes a method of washing fabric articles in a continuous batch tunnel washer, comprising providing a continuous batch tunnel washer preferably having an interior, an intake, a discharge, and a plurality of modules that segment the interior. The fabric articles can be moved preferably from the intake to the discharge. Washing chemical can preferably be added to the modules. After a selected time interval, counter flowing liquid can occur in the washer interior preferably along a flow path that is generally opposite the direction of travel of the fabric articles. Counter flowing water through the modules preferably effects a rinse of the fabric articles. Some of the modules can have an outer shell and some of the modules do not have an outer shell.

The present invention includes a method of washing fabric articles in a continuous batch tunnel washer, comprising providing a continuous batch tunnel washer preferably having an interior, an intake, a discharge, and a plurality of modules that segment the interior. The fabric articles can be moved preferably from the intake to the discharge and through the modules in sequence. A washing chemical can preferably be added to the modules. The fabric articles can then be washed. The fabric articles can be rinsed preferably by counter flowing liquid in the washer interior along a flow path that is generally opposite the direction of travel of the fabric articles. One or more of the modules can be rinse modules that preferably have a perforated scoop. In one embodiment, some of the modules do not have a perforated scoop.

The present invention includes a method of washing fabric articles in a continuous batch tunnel washer, comprising providing a continuous batch tunnel washer preferably having an interior, an intake, a discharge, a plurality of modules, and a volume of liquid. The fabric articles can be moved preferably from the intake to the modules and then to the discharge in sequence. One or more of the modules can have a perforated scoop and one or more of the modules preferably has an outer shell. In one embodiment, one or more of the modules does not have a perforated scoop. In one embodiment, counter flowing a rinsing liquid can occur along a flow path that is generally opposite the direction of travel of the fabric articles. In one embodiment, the pressure of the counter flowing rinsing liquid can be boosted preferably with a booster pump at one or more positions spaced in between the intake and the discharge.

In one embodiment, there can be multiple of the modules with perforated scoops.

In one embodiment, the booster pump can discharge liquid into a module that preferably has an outer shell.

In one embodiment, the booster pump can discharge liquid into a module that preferably does not have a perforated scoop.

In one embodiment, flow can be substantially halted for a time period.

In one embodiment, flow can be substantially halted for a time period that is preferably less than about three minutes.

In one embodiment, flow can be substantially halted for a time period that is preferably less than about two minutes.

In one embodiment, flow can be substantially halted for a time period that is preferably between about twenty and one hundred twenty (20-120) seconds.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1A:
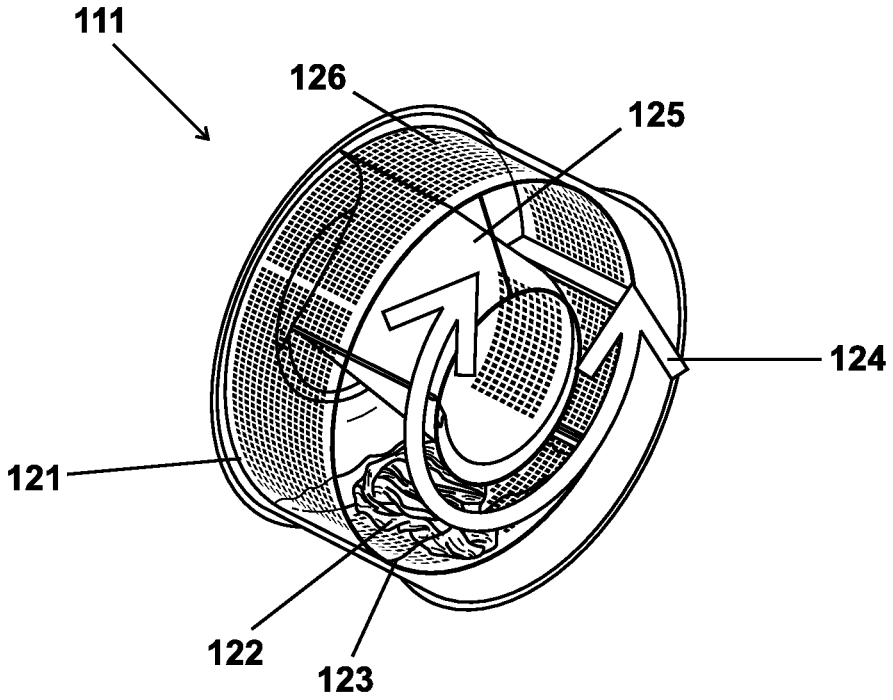
FIGS. 1A-1E illustrate operation of a top transfer tunnel washer.

FIGS. 1A-1E illustrate operation of a top transfer tunnel washer 111. In FIG. 1A, the initial step shows a module 121 before a transfer of fabric articles, linens or goods 122 to the next module Immediately before the tunnel washer 111 transfers all the batches of goods forward to the next module, the goods 122 are preferably submerged in the bath liquor 123 at the bottom of the module 121. The tunnel washer 111 imparts mechanical action on the goods preferably by reversing the cylinder 126 through an arc of approximately ¾ of a rotation, as indicated by arrow 124. For this phase of the cycle, the scoop 125, which is preferably part of and rotates with the cylinder 126, preferably does not interact with the goods 122.

Figure 1B:
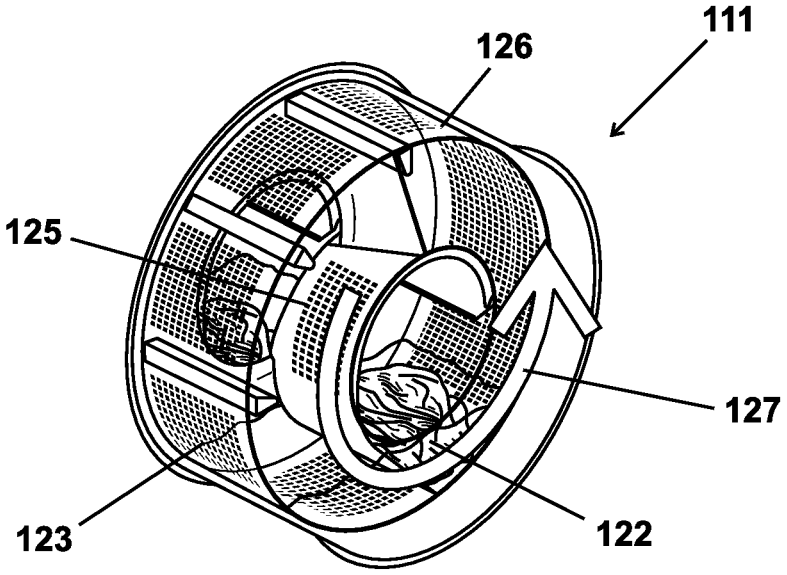

After the programmed number of reversals, the tunnel washer cylinder 126 preferably makes a complete rotation counter-clockwise as seen in FIG. 1B and indicated by arrow 127. When the scoop 125 crosses the bottom of the tunnel washer 111, it preferably collects the goods 122 and bath liquor 123.

Figure 1C:
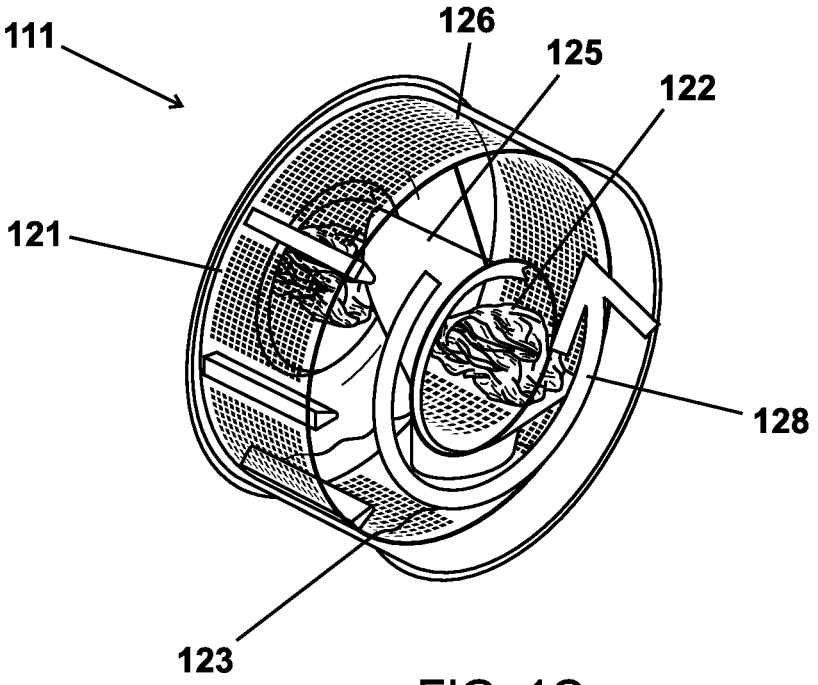

The counter-clockwise rotation preferably continues, as seen in FIG. 1C and indicated by arrow 128, which preferably lifts the goods 122 off the bottom of the tunnel washer 111. If the scoop 125 is perforated, the bath liquor 123 preferably drains back into the original module 121; otherwise, much of the bath liquor 123 is lifted along with the goods 122.

Figure 1D:
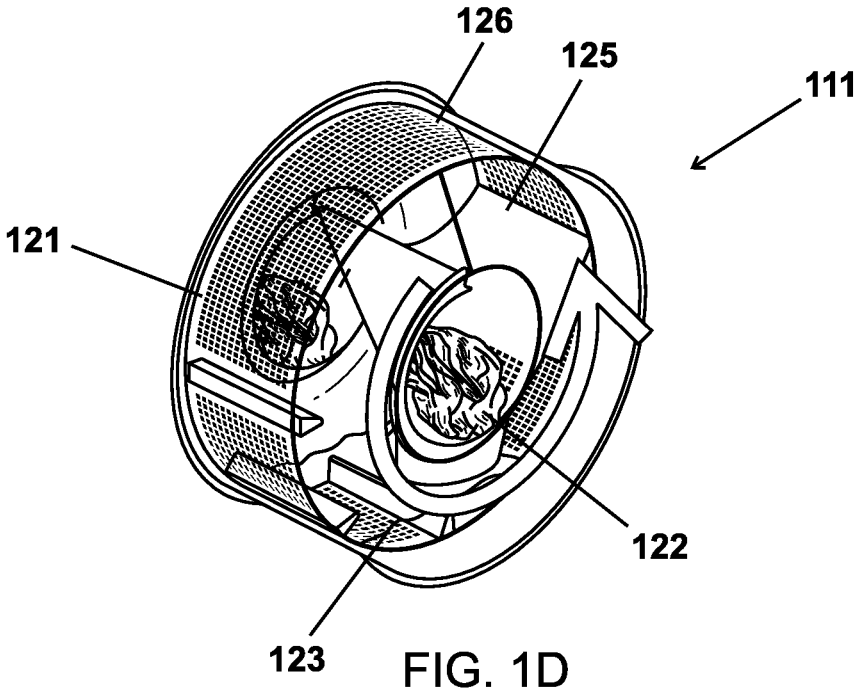
Figure 1E:
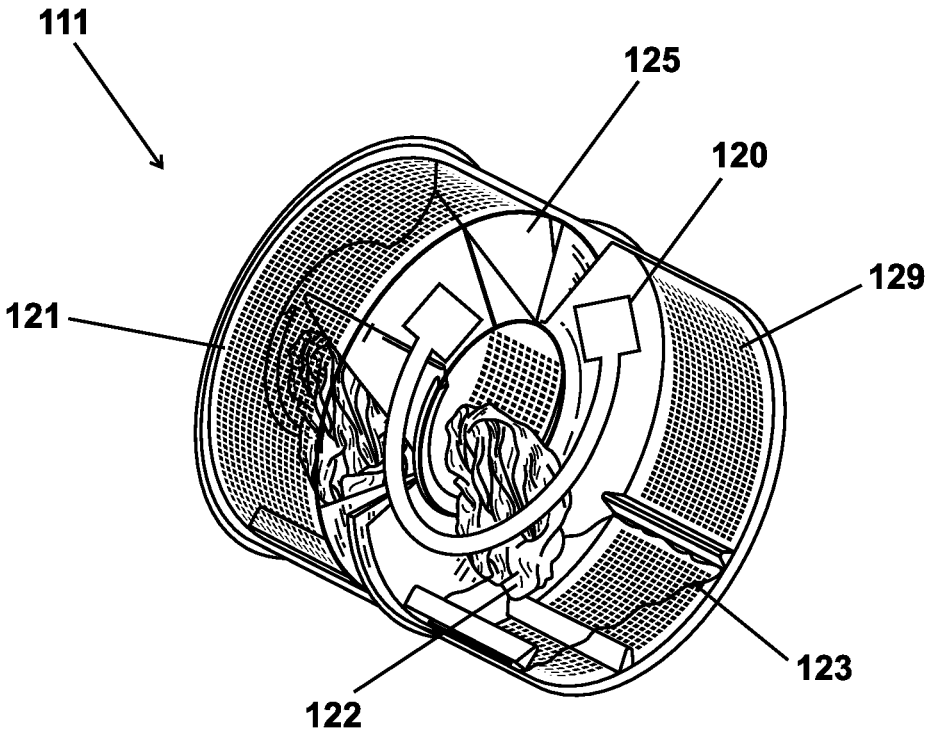

In FIG. 1D, the shape of the scoop 125 preferably causes the goods 122 to slide forward, preferably toward the next module 129 in the tunnel washer 111. If the scoop 125 is not perforated, a significant amount of bath liquor 123 is preferably also transferred forward in the tunnel washer.

As the scoop 125 rotates preferably to near the top of the tunnel washer (FIG. 1E), the rotation preferably pauses momentarily, as indicated by circular line 120, to let the goods 122 slide into the next module 129. After this pause 120, the tunnel washer 111 preferably resumes operating as shown and described in FIG. 1A.

Figure 2:
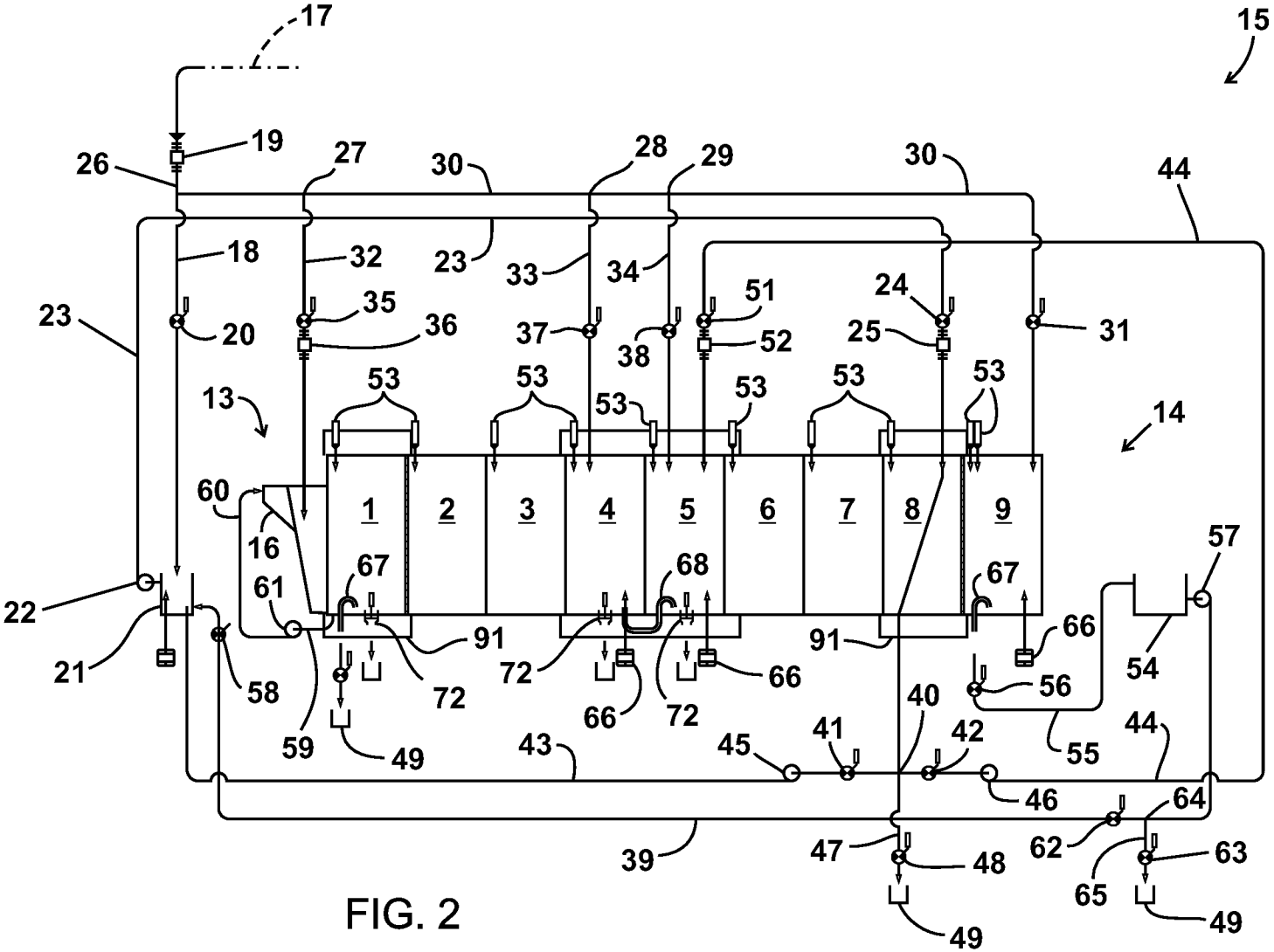
FIG. 2 is a schematic diagram view of a preferred embodiment of the apparatus of the present invention showing a nine-module apparatus.
Figure 3:
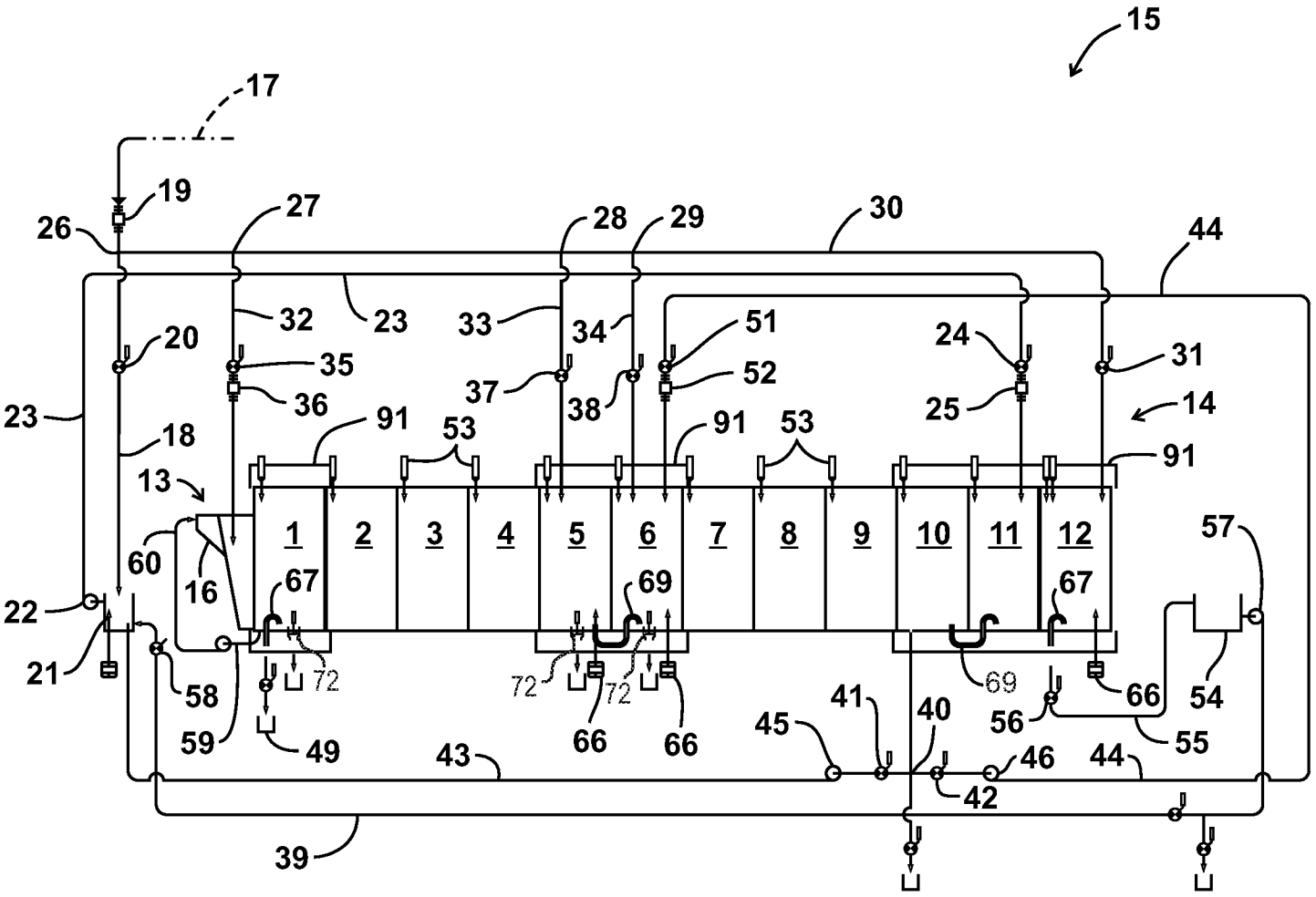
FIG. 3 is a schematic diagram view of a preferred embodiment of the apparatus of the present invention showing a twelve-module apparatus.

FIGS. 2-3 show a preferred embodiment of the apparatus of the present invention, designated generally by the numeral 15. Washing machine 15 has a plurality of modules or drums. In FIG. 2, the washing machine 15 has nine modules or drums 1, 2, 3, 4, 5, 6, 7, 8 and 9. In FIG. 3, washing machine 15 has twelve modules or drums 1, 2, 3, 4, 5, 6, 7, 8, 9, 10, 11 and 12. Machine 15 has end portions 13, 14. End portion 13 is an inlet end portion or inlet 13 where dirty or soiled fabric articles (e.g., linen articles or goods) are added at hopper 16.

A fresh water source 17 enables fresh water to be added to tank 21 via flow line 18. Flow line 18 can have flow meter 19 and valve 20. Pump 22 enables a discharge of water from tank 21 via flow line 23. Flow line 23 can be provided with valve 24 and flow meter 25. Flow line 30 joins to flow line 18 at tee fitting 26. Line 30 has tee fittings at 27, 28, 29. Flow line 30 can have valve 31. In FIG. 2, flow line 30 discharges into module or drum 9. In FIG. 3, flow line 30 discharges into module 12.

Flow line 32 connects to flow line 30 at tee fitting 27. Flow line 32 can have valve 35 and flow meter 36. Flow line 32 discharges into hopper 16. Flow line 33 connects to flow line 30 at tee fitting 28. Flow line 33 can have valve 37. Flow line 34 connects to flow line 30 at tee fitting 29. Flow line 34 can have valve 38. In FIG. 2, flow line 33 discharges into module 4. In FIG. 3, flow line 33 discharges into module 5. Each of the modules or drums 1, 2, 3, 4, 5, 6, 7, 8, 9 in FIG. 2 and also modules 10-12 in FIG. 3 can have a chemical injector 53 for adding selected chemicals such as detergent and bleach. Steam inlets can be provided at 66. For example, in FIG. 2 there are steam inlets 66 at modules 4-5 and 9. In FIG. 3, there are steam inlets 66 at modules 5-6 and 12. In a preferred embodiment of the present invention, there would be an outer shell 91 where there is steam inlet 66. In FIG. 2, module 1 has an outer shell as do modules 4-5 and 8. In FIG. 2, module 8 or modules 8 and 9 can have an outer shell 91. In FIG. 3, there is an outer shell 91 for module 1, modules 5-6 and for modules 10, 11, and 12.

Extracted water tank 54 receives water that is discharged from final module 9 (for FIG. 2) or module 12 (for FIG. 3). Extracted water tank 54 receives extracted water from an extractor (not shown) such as a centrifuge, press or the like. Such extractors are known and commercially available. Fabric articles containing water exit final module 9 or 12 and transfer to an extractor where water is extracted. Extracted water from final module 9 or 12 is transmitted via flow line 55 to extracted water tank 54. Line 55 can have valve 56. Water can be transmitted from extracted water tank 54 to tank 21 via flow line 39. Pump 57 can be provided in flow line 39. Flow line 39 can have valve 58 which can be placed next to tank 21.

At junction or cross fitting 40, flow can be selected to go to sewer 49 via line 47 and valve 48. Flow can selectively go to line 43 or 44 from junction or cross fitting 40. Line 43 has valve 41 and pump 45. Line 43 transmits water to tank 21. Line 44 has valve 42 and pump 46. Line 44 also has a valve 51 and meter 52. Line 44 transmits water from junction or cross fitting 40 to module 5 in FIG. 2. This water counterflows from module 5 to module 4.

In FIG. 2, module 8 is a rinse module that receives water flow from line 23. That rinse water then flows to junction or cross fitting 40. In FIG. 2, the modules 1, 4-5 and 8 are modules with outer shells 91. In FIG. 2, module 8 or modules 8 and 9 can have an outer shell 91. In FIG. 3, the modules 1, 5-6 and 10-12 are modules with outer shells 91. Module 9 could optionally have a shell 91 in FIG. 2. In FIG. 2, modules 2, 3, 6 and 7 do not have an outer shell 91. In FIG. 2, modules 4 and 8 preferably have perforated scoops. In FIG. 2, modules 1-3, 5-7 and 9 preferably do not have perforated scoops. Modules having shells and/or perforated scoops can be seen in FIGS. 7-8.

Recirculation flow lines 59, 60 transmit flow from module 1 to hopper 16. Pump 61 receives flow from line 59 and discharges flow to line 60. In FIG. 2, module 8 is preferably a rinsing drum with perforated scoop. Rinse water from line 23 receives water from tank 21 and directs that water to and through module 8, then to junction or cross fitting 40. Tank 21 can optionally be replenished by fresh water source 17. Tank 21 can optionally be replenished by recirculated rinse water via flow line 43. Tank 21 can optionally receive extracted water via flow lines 55, 39 and extracted water tank 54. Line 39 can have tee fitting 64 and valve 62. Flow line 65 with valve 63 enables discharge of line 39 to sewer 49. Flow lines 33 and 34 enable addition of water to modules 4, 5 respectively in FIG. 2 and in modules 5, 6 respectively in FIG. 3. Flow line 44 enables addition of water to module 5 in FIG. 2 (module 6 in FIG. 3).

Figure 7:
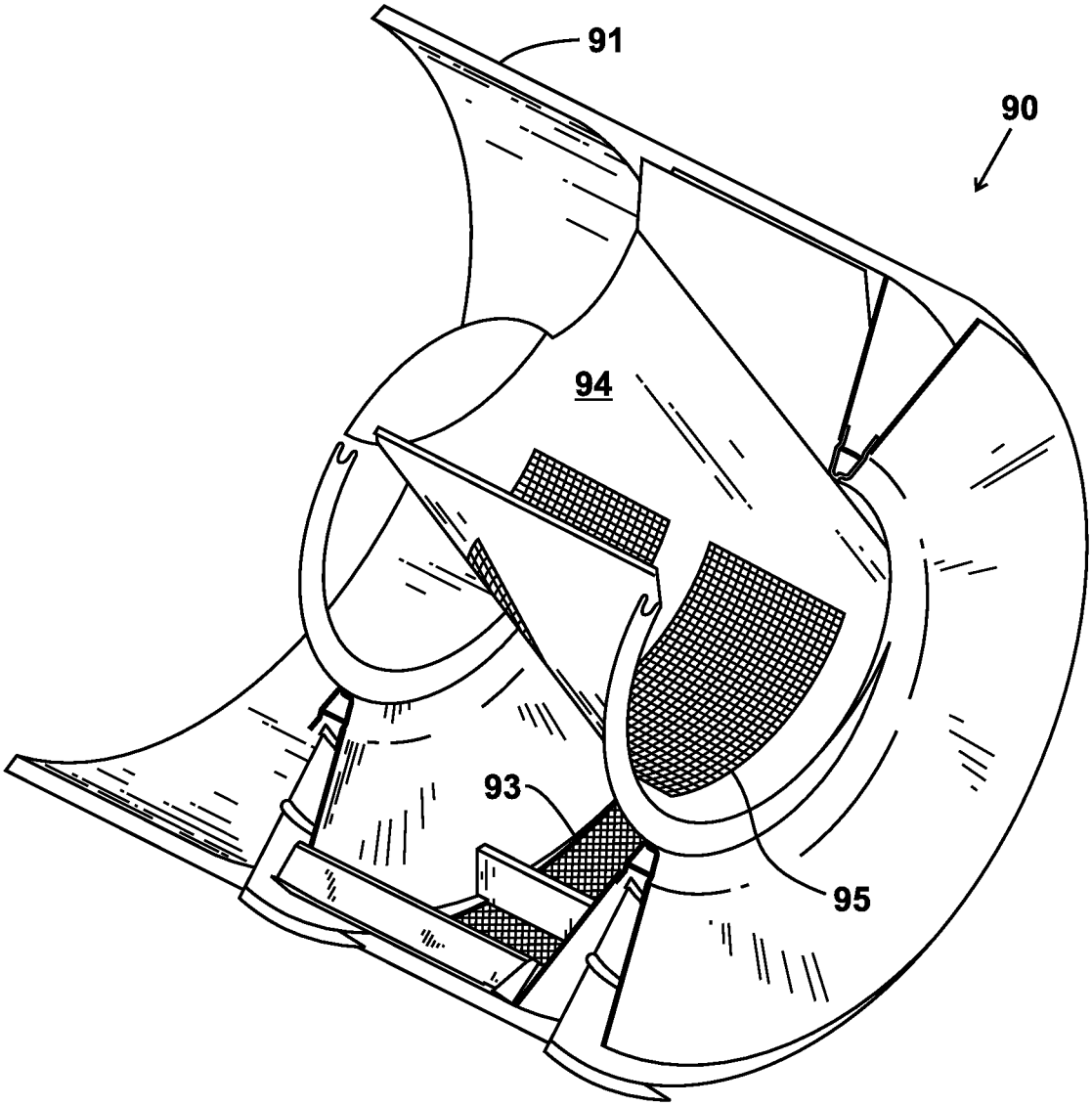
FIG. 7 is a partial perspective view of a preferred embodiment of the apparatus of the present invention.
Figure 8:
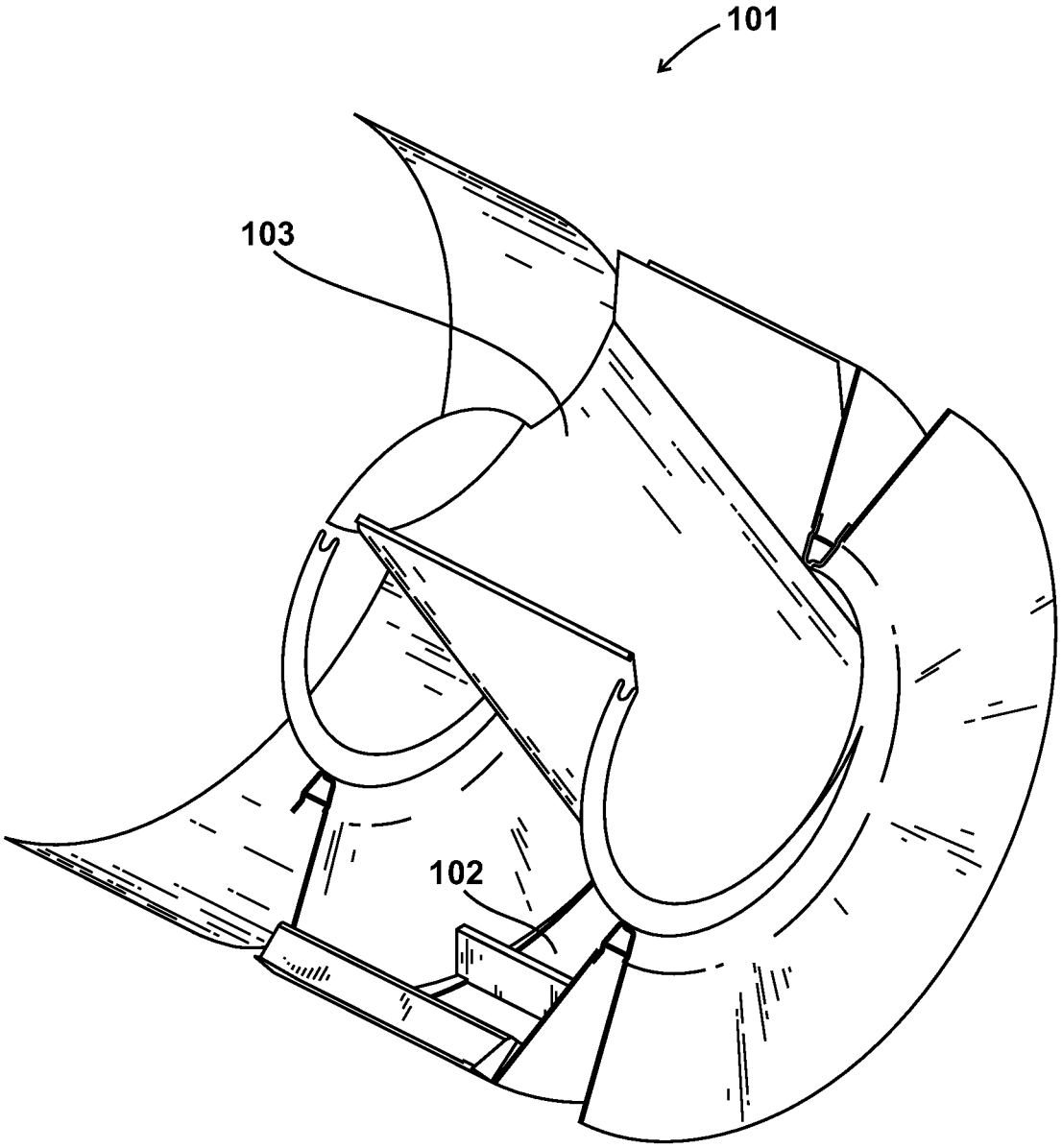
FIG. 8 is a partial perspective view of a preferred embodiment of the apparatus of the present invention.

In FIG. 3, flow lines 33 and 34 enable addition of water to modules 5-6 respectively. Flow line 44 enables addition of water to module 6. In FIG. 3, modules 1, 5-6 and 10-12 can be modules with outer shells 91. Outer shells 91 are fixed and do not rotate. In FIG. 3, modules 2-4, and 7-9 can be modules with no outer shell 91. In FIG. 3, modules 1, 5 and 10-11 can be modules that each have a perforated scoop as seen in FIG. 7. In FIG. 3, modules 2-4 and 7-9 can be modules each preferably having no perforated scoop. As seen in FIG. 3, it is a similar arrangement to FIG. 2 but with three additional modules 10, 11, and 12. Overflow drains 67 to sewer 49 can be provided in FIG. 2 at modules 1 and 9 and at modules 1 and 12 for FIG. 3. Line 68 enables counterflow from module 5 to module 4 in FIG. 2. Lines 69 enable counterflow from module 6 to module 5 and from module 11 to module 10 in FIG. 3. Drains 72 can be provided at modules 1, 4 and 5 in FIG. 2 (modules 1, 5, and 6 in FIG. 3).

Figure 4:
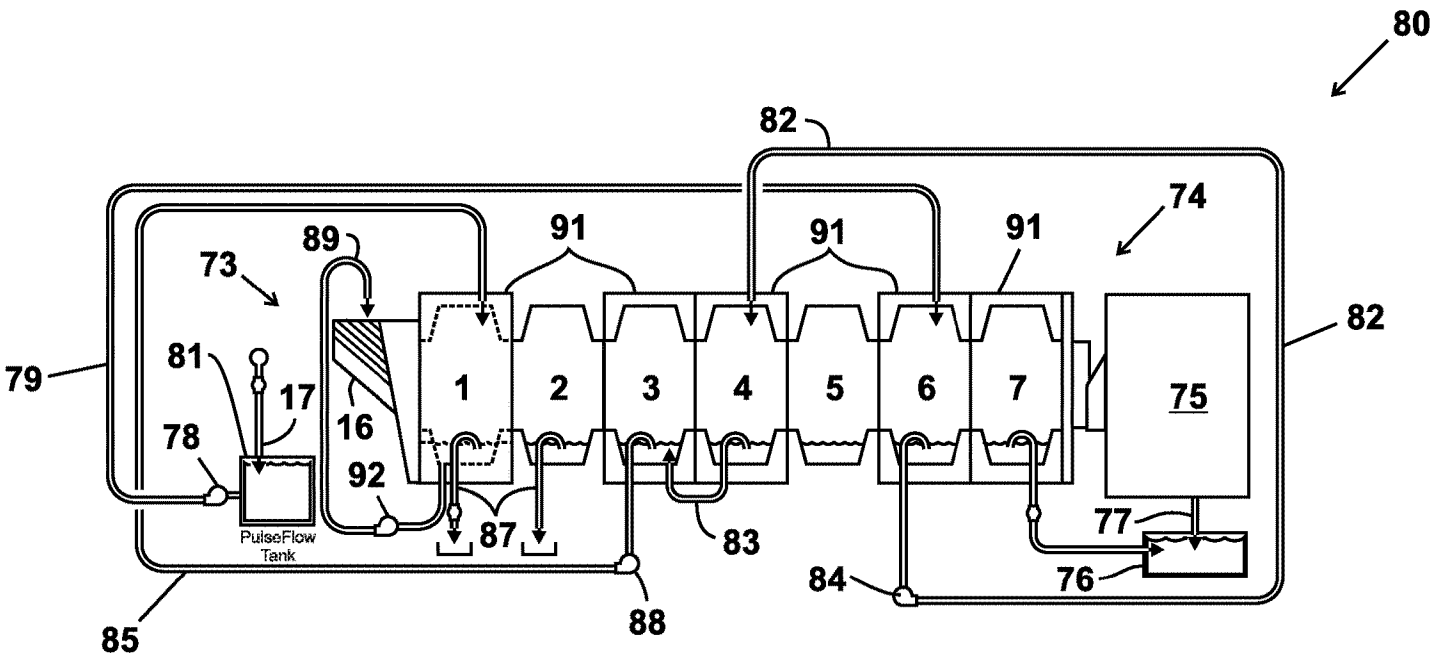
FIG. 4 is a schematic diagram view of a preferred embodiment of the apparatus of the present invention showing a seven-module apparatus.
Figure 5:
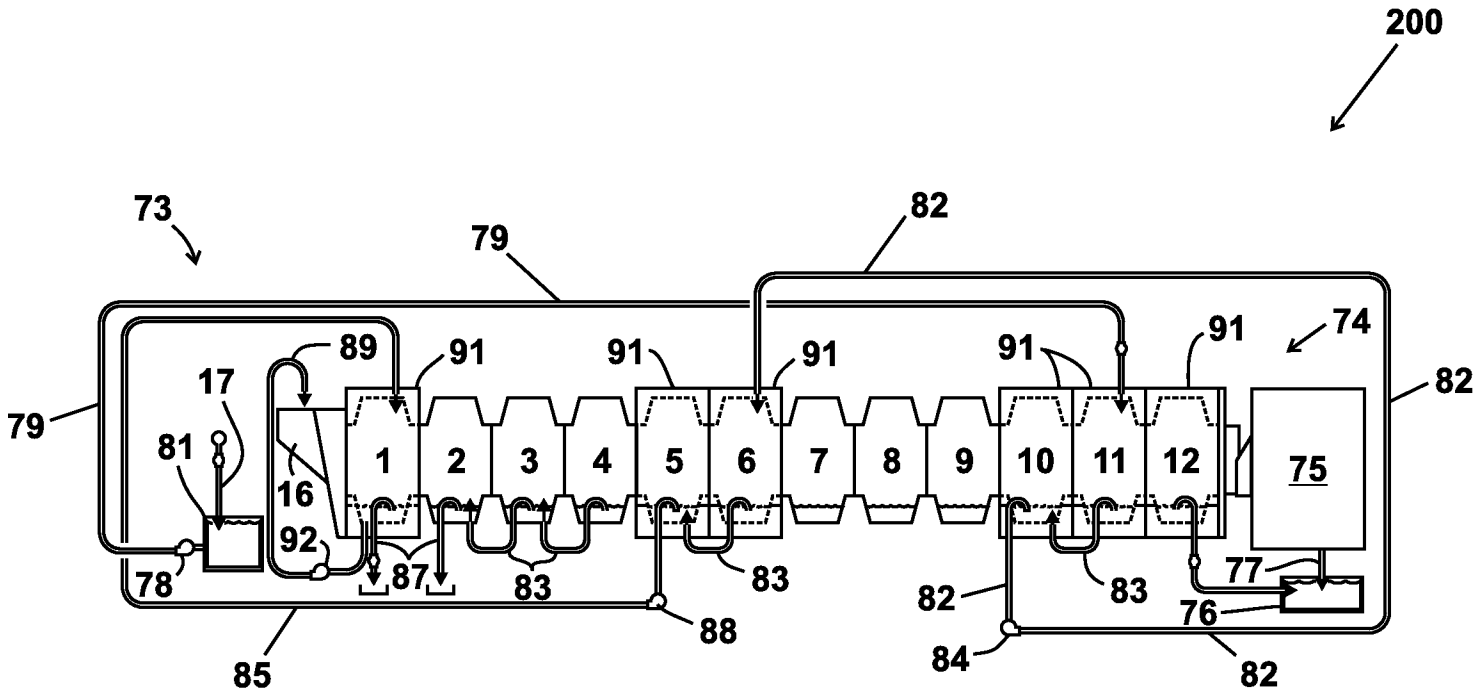
FIG. 5 is a schematic diagram view of a preferred embodiment of the apparatus of the present invention showing a twelve-module apparatus.
Figure 6:
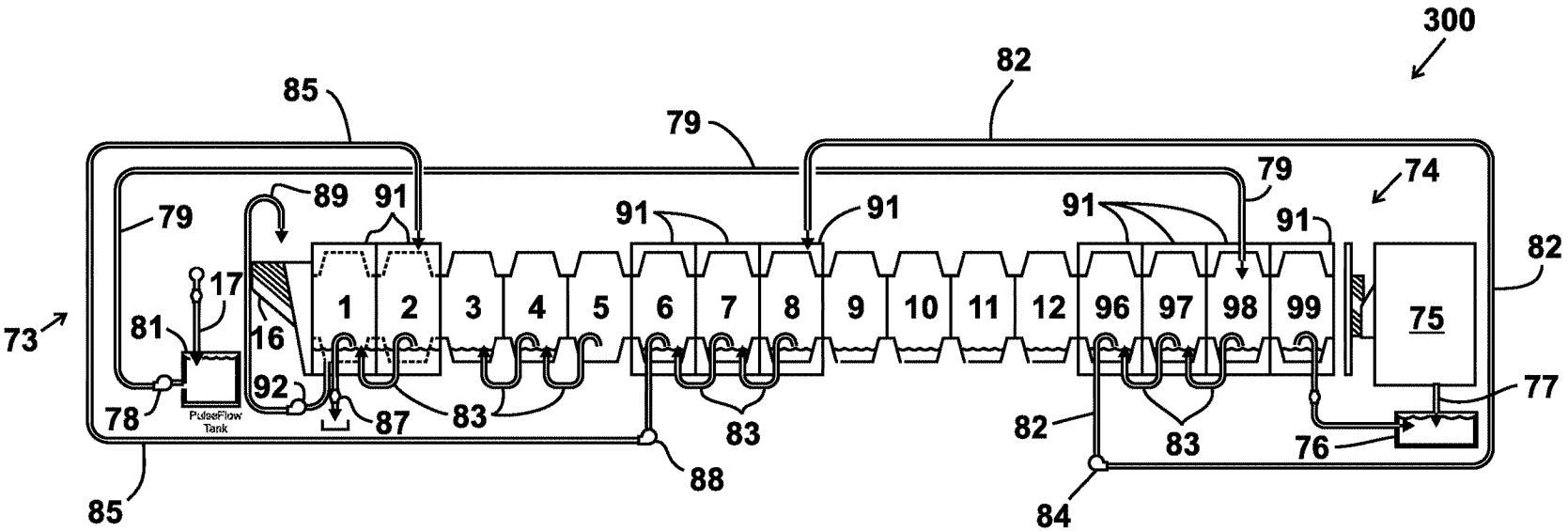
FIG. 6 is a schematic diagram view of a preferred embodiment of the apparatus of the present invention showing a sixteen-module apparatus.

FIGS. 4, 5 and 6 show another embodiment of the apparatus of the present invention. FIGS. 4, 5, and 6 are similar in that some modules have outer shells, some modules have perforated scoops, some modules have no outer shell (and are thus less expensive to construct), and some modules have scoops that are not perforated.

In FIGS. 4, 5, and 6, high speed, high flow counterflow rinsing is combined with lower cost modules that do not require an outer shell to provide better dilution than prior art washers that have all modules with no shells.

FIG. 4 illustrates a seven (7) module embodiment of the present invention designated by the number 80. In FIG. 4, module 1 defines a pre-wash and wash zone. Module 2 is a conveyor module. Module 3 is a drain plus alkali. Module 4 is for addition of chemicals (e.g., dilution plus bleach) and for temperature elevation (e.g., using steam). Modules 3 and 4 also have an outer shell 91. Module 5 is a carryover module. Modules 6 and 7 each have shells 91. Modules 6-7 provide ph and softener.

In the seven (7) module tunnel washer 80 of FIG. 4, the numeral 73 designates an intake end portion while the numeral 74 designates a discharge end portion. As with FIGS. 2-3, washer 80 has an intake chute or hopper 16. An extractor 75 receives fabric articles or linens from module 7 at discharge end portion 74. Tank 76 receives extracted water from extractor 75 via flow line 77.

Modules 1, 3-4 and 6-7 have outer shells 91. Modules 2 and 5 do not have outer shells 91. An outer shell 91 enables addition of water, chemicals, bleach, and steam injection. The outer shells 91 are stationary. Those modules having a shell typically have a perforated scoop. Those modules with no shell do not have a perforated scoop.

Pump 78 transmits fluid/water via flow line 79 from tank 81 to module 6. Fluid/water in module 6 discharges via flow line 82 to module 4 and then counterflows to module 3 via counterflow line 83. Flow line 82 can have a pump 84. From module 3, fluid/water flows via flow line 85 to module 1. Flow line 85 can have pump 88. Modules 1 and 2 can have drains or drain lines 87 to sewer. Module 1 is a prewash and wash module. Module 2 is a carryover module. A flow line 89 can be provided for transmitting water/fluid from module 1 to hopper 16. Flow line 89 can be provided with a pump 92.

FIG. 5 is a diagram of a twelve (12) module tunnel washer (e.g., top transfer tunnel washer), designated generally by the numeral 200. FIG. 5 is similar to FIG. 4 but adds modules without outside shells downstream of module 1. In FIG. 5, modules 2, 3 and 4 are modules without outside shells and without a perforated scoop. In FIG. 5, module 1 is a pre-wash module. Modules 2, 3, and 4 are carryover modules. Module 5 is a dilution (drain) plus alkali (or other chemical) addition modules. Module 6 is a dilution plus bleach (or other chemical) addition module. Modules 1, 5 and 6 have outer shells 91. Modules 7, 8 and 9 are carryover modules. Modules 10 and 11 are rinse modules having outer shells 91. Module 12 is a ph adjustment and softener (or other chemical) addition module.

In FIG. 5, tanks are provided at 76, 81. Tank 76 is an extracted water tank. Tank 81 is a tank using fluid/water for counterflow at a high flow rate (e.g., 400 cubic feet per minute (11.33 cubic meters per minute)). In FIG. 5, counterflow is from module 11 to module 10 to module 6 to module 5 to module 1 using flow lines 83, 82 and 85. Flow line 79 can have a pump 78. Flow line 82 can have a pump 84. Flow line 85 can have a pump 88. Counterflow lines 83 are provided between modules 6 and 5 (for counterflow from module 6 to module 5) for counterflow from module 4 to module 3 and from module 3 to module 2. A flow line 89 can be provided for transmitting water/fluid from module 1 to hopper 16. Flow line 89 can be provided with a pump 92.

FIG. 6 shows a sixteen (16) module apparatus, designated generally by the numeral 300. FIG. 6 is similar to FIG. 5 but with additional modules 96, 97, 98, 99. Module 1 is a prewash module. Module 2 is a wash module. Modules 1 and 2 have outer shells 91. Modules 3, 4, and 5 are carry over modules.

Module 6 is a dilution (drain) plus chemical addition (e.g., alkali) module. Module 7 is a rinse module. Module 8 is a dilution plus chemical addition (e.g., bleach) module. Modules 6, 7 and 8 have outer shells 91 and perforated scoops. Modules 9, 10, 11, 12 are carry over modules with no perforated scoops. Modules 96-98 are rinse modules. Module 99 is a ph adjustment and chemical addition (e.g., softener) module. Otherwise, FIG. 6 operates as FIGS. 4 and 5 with counterflow flow lines 82, 83, 85 and fluid holding tanks 76, 81 as shown in FIG. 6.

The present invention improves washing and rinsing functions as pulse flow velocity rinsing (e.g., flow lines 79, 82 and 85) replaces continuous counterflow. Because of the efficiency of the high velocity (e.g., about 80 to 180 GPM (about 302.83 to 681.37 liters per minute) in a preferred embodiment of the present invention), fewer modules or drums are required for the same level of dilution. The rinsing modules or drums 90 (see FIG. 7, i.e., modules 4, 5 and 8 in FIG. 2 and modules 1, 5-6, 10-12 in FIG. 3) preferably have scoops 94 with perforations 95 and an outer shell 91 to improve rinsing efficiency. Inner shell 93 and scoop 94 rotate together. In most applications, preferably only one rinsing drum or module 90 is required. Each module or drum 90 preferably has a scoop 94 with perforations at 95 and a perforated inner wall at 93 to drain the free water when transferring to the next module or drum.

Drums or modules without shells are carryover modules 101 (see FIG. 8) and preferably have scoops (for linen transfer) with no perforations 103. Thus, the linen (fabric articles) and all water preferably goes to the next downstream drum or module; carryover modules 101 have no outer shell 91 but have inner shell/inner wall 102 with no perforations and scoop 103 that rotate together. The present invention has much lower manufacturing cost. Fewer drums results in lower cost with improved washing and rinsing.

The following is a list of parts and materials suitable for use in the present invention:

PARTS LIST

| Parts Number | Description |
|---|---|
| 1 | module/drum |
| 2 | module/drum |
| 3 | module/drum |
| 4 | module/drum |
| 5 | module/drum |
| 6 | module/drum |
| 7 | module/drum |
| 8 | module/drum |
| 9 | module/drum |
| 10 | module/drum |
| 11 | module/drum |
| 12 | module/drum |
| 13 | inlet/inlet end portion |
| 14 | outlet/outlet end portion |
| 15 | washing machine apparatus/tunnel washer |
| 16 | hopper |
| 17 | fresh water source |
| 18 | flow line |
| 19 | flow meter |
| 20 | valve |
| 21 | tank |
| 22 | pump |
| 23 | flow line |
| 24 | valve |
| 25 | flow meter |
| 26 | tee fitting |
| 27 | tee fitting |
| 28 | tee fitting |
| 29 | tee fitting |
| 30 | flow line |
| 31 | valve |
| 32 | flow line |
| 33 | flow line |
| 34 | flow line |
| 35 | valve |
| 36 | flow meter |
| 37 | valve |
| 38 | valve |
| 39 | flow line |
| 40 | junction/cross fitting |
| 41 | valve |
| 42 | valve |
| 43 | flow line |
| 44 | flow line |
| 45 | pump |
| 46 | pump |
| 47 | flow line |
| 48 | valve |
| 49 | sewer |
| 51 | valve |
| 52 | meter |
| 53 | chemical injector |
| 54 | extracted water tank |
| 55 | flow line |
| 56 | valve |
| 57 | pump |
| 58 | valve |
| 59 | flow line |
| 60 | flow line |
| 61 | pump |
| 62 | valve |
| 63 | valve |
| 64 | tee fitting |
| 65 | flow line |
| 66 | steam inlet |
| 67 | overflow drain |

-continued

| Parts Number | Description |
|---|---|
| 68 | flow line |
| 69 | flow line |
| 70 | flow line |
| 71 | booster pump |
| 72 | drain/drain valve |
| 73 | intake end portion |
| 74 | discharge end portion |
| 75 | extractor |
| 76 | extracted water tank |
| 77 | flow line |
| 78 | pump |
| 79 | flow line |
| 80 | washing machine apparatus/tunnel washer |
| 81 | tank |
| 82 | flow line |
| 83 | flow line |
| 84 | pump |
| 85 | flow line |
| 87 | drain/drain line |
| 88 | pump |
| 89 | flow line |
| 90 | module/drum |
| 91 | outer shell |
| 92 | pump |
| 93 | perforated inner shell/inner wall |
| 94 | scoop |
| 95 | perforation |
| 96 | module |
| 97 | module |
| 98 | module |
| 99 | module |
| 101 | carry over module |
| 102 | inner shell/inner wall with no perforations |
| 103 | scoop without perforation |
| 111 | top transfer tunnel washer |
| 120 | arrow |
| 121 | module |
| 122 | fabric articles/linens/goods |
| 123 | bath liquor |
| 124 | arrow |
| 125 | scoop |
| 126 | cylinder |
| 127 | arrow |
| 128 | arrow |
| 129 | module |
| 200 | washing machine apparatus/tunnel washer |
| 300 | washing machine apparatus/tunnel washer |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of washing fabric articles in a continuous batch tunnel washer, comprising the steps of:

a) providing a continuous batch tunnel washer having an interior, an intake, a discharge, a plurality of modules that include a first module, a last module, multiple interior modules in between said first and said last module, and a volume of liquid;

b) moving the fabric articles from the intake to the modules and then to the discharge in sequence;

c) not counter flowing a rinsing liquid in the washer interior for a selected time interval after step "b";

d) after step "c", counter flowing a rinsing liquid along a flow path that is generally opposite the direction of travel of the fabric articles in step "b" and at first and second spaced apart positions;

e) wherein one or more of said modules have a perforated scoop and an outer shell and one or more of said modules have no outer shell; and f) wherein each of the one or more modules with no outer shell is a carryover module having a scoop that transfers both the fabric articles and liquid to the next downstream module, at least one carryover module being an interior module positioned in between the first and last modules.

2. The method of claim 1 wherein in step "d" one or more booster pumps are provided, each pump boosting counter flowing rinsing liquid flow rate at a different one of said modules.

3. The method of claim 2 wherein the one or more booster pumps are spaced apart by more than one module.

4. The method of claim 2 wherein in step "d" the one or more booster pumps discharge liquid into a module that has a said outer shell.

5. The method of claim 2 wherein the one or more booster pumps each discharge liquid into a module that has a non-perforated scoop.

6. The method of claim 4 wherein flow is substantially halted for a time period that is less than about five minutes.

7. The method of claim 4 wherein flow is substantially halted for a time period that is less than about three minutes.

8. The method of claim 4 wherein flow is substantially halted for a time period that is less than about two minutes.

9. The method of claim 4 wherein flow is substantially halted for a time period that is between about twenty and one hundred twenty (20-120) seconds.

10. The method of claim 1 wherein in step "e" there are a first number of modules having an outer shell and a second, greater number of modules having no outer shell.

11. The method of claim 1 wherein there are multiple modules having an outer shell that are next to each other.

12. The method of claim 1 wherein there are multiple modules having no outer shell that are in between modules having an outer shell.

13. The method of claim 1 wherein the modules include first and last modules each having an outer shell.

14. A method of washing fabric articles in a continuous batch tunnel washer, comprising the steps of:

a) providing a continuous batch tunnel washer having an interior, an intake, a discharge, and a plurality of modules that segment the interior, said modules including a first module, a final module and multiple interior modules in between said first and final modules;

b) moving the fabric articles from the intake to the discharge;

c) adding a washing chemical to one or more of the modules;

d) after a selected time interval and after step "c", counter flowing liquid in the washer interior along a flow path that is generally opposite the direction of travel of the fabric articles in step "b";

e) counter flowing water through the modules to effect a rinse of the fabric articles;

f) wherein some of the modules have an outer shell and some of the modules do not have an outer shell;

g) wherein one or more of the modules having an outer shell have a perforated scoop; and h) wherein the modules with no outer shell are carryover modules, each having a scoop that is not perforated and that transfers both the fabric articles and liquid to the next downstream module, at least one or more of said carryover modules being an interior module that is positioned in between the first and final modules.

15. A method of washing fabric articles in a continuous batch tunnel washer, comprising the steps of:

a) providing a continuous batch tunnel washer having an interior, an intake, a discharge, and a plurality of modules that segment the interior, said modules including a first module, a final module and multiple interior modules in between the first and final modules;

b) moving the fabric articles from the intake to the discharge and through the modules in sequence;

c) adding a washing chemical to one or more of the modules;

d) washing the fabric articles after step "c" in one or more of the modules;

e) after completion of steps "c" and "d", rinsing the fabric articles by counter flowing liquid in the washer interior along a flow path that is generally opposite the direction of travel of the fabric articles in step "b"; and f) wherein one or more of the modules are rinse modules that have a perforated scoop;

g) wherein one or more of the rinse modules has an outer shell; and h) wherein one or more of the interior modules has no outer shell and is a carryover module having a non-perforated scoop that transfer both the fabric articles and liquid to the next downstream module.

16. A method of washing fabric articles in a continuous batch tunnel washer, comprising the steps of:

a) providing a continuous batch tunnel washer having an interior, an intake, a discharge, a plurality of modules, and a volume of liquid;

b) moving the fabric articles from the intake to the modules and then to the discharge in sequence;

c) wherein in step "b" one or more of the modules has a perforated scoop;

d) counter flowing a rinsing liquid at spaced apart first and second positions along a flow path that is generally opposite the direction of travel of the fabric articles in steps "b" and "c";

e) during step "e" boosting pressure of the counter flowing rinsing liquid with a booster pump at one or more positions spaced in between the intake and the discharge; and f) carrying over the fabric articles and rinsing liquid from one module to another module with a module that has a non-perforated scoop and that is located in between said first and second spaced apart positions.

17. The method of claim 16 wherein there are multiple said modules with perforated scoops.

18. The method of claim 16 wherein in step "e" the one or more booster pumps discharge liquid into a module that has an outer shell.

19. The method of claim 16 wherein the one or more booster pumps discharge liquid into a module that has a non-perforated scoop.

20. The method of claim 18 wherein flow is substantially halted for a time period after step "c".

21. The method of claim 20 wherein flow is substantially halted for a time period that is less than about three minutes.

22. The method of claim 20 wherein flow is substantially halted for a time period that is less than about two minutes.

23. The method of claim 20 wherein flow is substantially halted for a time period that is between about twenty and one hundred twenty (20-120) seconds.

24. A method of washing fabric articles in a continuous batch tunnel washer, comprising the steps of:

a) providing a continuous batch tunnel washer having an interior, an intake, a discharge, a plurality of modules that include a first module, a last module, multiple interior modules in between said first and said last module, and a volume of liquid;

b) moving the fabric articles from the intake to the modules and then to the discharge in sequence;

c) not counter flowing a rinsing liquid in the washer interior for a selected time interval after step "b";

d) after step "c", counter flowing a rinsing liquid along a flow path that is generally opposite the direction of travel of the fabric articles in step "b" and at first and second spaced apart positions;

e) wherein one or more of said modules has a perforated scoop and an outer shell and one or more of said modules is a carryover module having a scoop that transfers both the fabric articles and liquid to the next downstream module, at least one carryover module being an interior module positioned in between the first and last modules.

25. The method of claim 24 wherein in step "d" one or more booster pumps are provided, each pump boosting counter flowing rinsing liquid at a different one of said modules.

26. The method of claim 25 wherein there are two booster pumps spaced apart by more than one module.

27. The method of claim 25 wherein in step "d" a said booster pump discharges liquid into a module that has a said outer shell.

28. The method of claim 25 wherein the one or more booster pumps each discharge liquid into a module that has a non-perforated scoop.

* * * * *